US008469213B2

(12) United States Patent
Ishii et al.

(10) Patent No.: US 8,469,213 B2
(45) Date of Patent: Jun. 25, 2013

(54) SYNTHETIC RESIN CONTAINER CLOSURE

(75) Inventors: Osamu Ishii, Kanagawa (JP); Takashi Kimura, Kanagawa (JP); Seiji Fukushi, Okayama (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 206 days.

(21) Appl. No.: 13/002,908

(22) PCT Filed: Jul. 1, 2009

(86) PCT No.: PCT/JP2009/062043

§ 371 (c)(1),
(2), (4) Date: Jan. 6, 2011

(87) PCT Pub. No.: WO2010/004919

PCT Pub. Date: Jan. 14, 2010

(65) Prior Publication Data

US 2011/0114593 A1 May 19, 2011

(30) Foreign Application Priority Data

Jul. 8, 2008 (JP) ..... 2008-178225
Sep. 29, 2008 (JP) ..... 2008-251045

(51) Int. Cl.
*B65D 55/16* (2006.01)
*B65D 41/00* (2006.01)

(52) U.S. Cl.
USPC ..... 215/252; 215/253; 215/258; 215/306; 220/375; 220/810; 220/836; 220/837

(58) Field of Classification Search
USPC ..... 215/217, 252, 253, 258, 306; 220/375, 220/810, 836, 837, 843, 845, 847
See application file for complete search history.

(56) References Cited

U.S. PATENT DOCUMENTS

| | | | |
|---|---|---|---|
| 5,215,204 | A | 6/1993 | Beck et al. |
| 6,474,491 | B1 | 11/2002 | Benoit-Gonin et al. |
| 2010/0219186 | A1 | 9/2010 | Kuwagaki et al. |

FOREIGN PATENT DOCUMENTS

| | | | |
|---|---|---|---|
| CN | 1117723 | | 2/1996 |
| JP | 2005-15052 | A | 1/2005 |
| JP | 2007-191206 | A | 8/2007 |
| JP | 2008-56246 | A | 3/2008 |
| WO | 94/18085 | | 8/1994 |

OTHER PUBLICATIONS

Search report from E.P.O., mail date is May 17, 2011.
China Office Action, dated Jan. 18, 2012 along with an English language translation thereof.

*Primary Examiner* — Anthony Stashick
*Assistant Examiner* — Madison L Poos
(74) *Attorney, Agent, or Firm* — Greenblum & Bernstein, P.L.C.

(57) ABSTRACT

[Problems to be Solved] In a synthetic resin container closure of a type which includes a body and a tamper evident bottom portion connected to the body via a plurality of breakable bridge portions arranged with spacing in a circumferential direction, and in which the body continues to be connected via unbroken connecting pieces to the tamper evident bottom portion continuously mounted on a mouth-and-neck portion of a container even after the bridge portions are broken to remove the body from the mouth-and-neck portion of the container, an improvement is made so that the container closure can be applied, without posing problems, even when the ascent distance of the body when removed is relatively long. [Means to Solve the Problems] Each of the unbroken connecting pieces is in such a form as to include two tilting portions whose tilting directions are opposite to each other.

7 Claims, 9 Drawing Sheets

SYNTHETIC RESIN CONTAINER CLOSURE

TECHNICAL FIELD

This invention relates to a synthetic resin container closure having tamper evident properties of a type which is not separated, as a whole, from a container even after a mouth-and-neck portion of the container is unsealed. More particularly, the invention relates to a synthetic resin container closure of a type which includes a body and a tamper evident bottom portion connected to the body via a plurality of breakable bridge portions arranged with spacing in a circumferential direction, and in which the body continues to be connected via unbroken connecting pieces to the tamper evident bottom portion continuously mounted on the mouth-and-neck portion of the container even after the bridge portions are broken to release the body from the mouth-and-neck portion of the container.

BACKGROUND ART

A synthetic resin container closure having tamper evident properties is applied to a container which has an external thread formed on the outer peripheral surface of a mouth-and-neck portion and an engaging jaw portion formed to be located below the external thread. As such a synthetic resin container closure, Patent Document 1 to be described below discloses a synthetic resin container closure including a body which has a top panel wall, and a cylindrical skirt wall extending downwardly from the peripheral edge of the top panel wall, and in which an internal thread to be screwed to the external thread of the mouth-and-neck portion is formed on the inner peripheral surface of the skirt wall; and a cylindrical tamper evident bottom portion which is connected to the skirt wall of the body via a plurality of breakable bridge portions arranged with spacing in a circumferential direction, and in which an engaging means to be engaged with the engaging jaw portion of the mouth-and-neck portion is disposed on the inner peripheral surface of the cylindrical tamper evident bottom portion. A protruding piece protruding downward is disposed on the skirt wall of the body. On both sides in the circumferential direction of the protruding piece, there are disposed unbroken connecting pieces which connect the skirt wall of the body and the tamper evident bottom portion and which each have a tilting portion whose inclination angle with respect to a vertical line is gradually decreased when the body is moved upward with respect to the tamper evident bottom portion.

In mounting the above-described container closure on the mouth-and-neck portion of the container to seal the mouth-and-neck portion, the container closure is fitted on the mouth-and-neck portion, and rotated in a closing direction to screw the internal thread of the container closure to the external thread of the mouth-and-neck portion. As the screwing proceeds, the container closure is lowered down the mouth-and-neck portion, and the engaging means locked to the tamper evident bottom portion elastically passes over the engaging jaw portion of the mouth-and-neck portion until it is engaged below the engaging jaw portion. In unsealing the mouth-and-neck portion, the container closure is rotated in an opening direction to release the screwing between the external thread of the mouth-and-neck portion and the internal thread of the container closure. Along with the release of the screwing, the body of the container closure is allowed to ascend relative to the mouth-and-neck portion. On the other hand, the tamper evident bottom portion is inhibited from ascending, because its engaging means is engaged with the engaging jaw portion of the mouth-and-neck portion. Thus, stress is caused to the breakable bridge portions, whereby the breakable bridge portions are broken. When the breakable bridge portions are broken, the body continues to ascend, and the body is spaced upward from the tamper evident bottom portion, the tilting portions of the unbroken connecting pieces have their inclination with respect to the vertical line gradually decreased accordingly. Even after the body is removed from the mouth-and-neck portion, the tamper evident bottom portion continues to be mounted on the mouth-and-neck portion, while the body continues to be connected to the tamper evident bottom portion via the unbroken connecting pieces. Consequently, the container closure is not separated from the container.

PRIOR ART DOCUMENTS

Patent Literature

Patent Document 1: JP-A-2008-56246

SUMMARY OF THE INVENTION

Problems to be Solved by the Invention

The above-described container closure disclosed in the Patent Document 1, however, poses the following problems to be solved: First, the unbroken connecting piece is composed of the single tilting portion alone, and the circumferentially extending distance of the unbroken connecting piece is limited to a region where the breakable bridge portion does not exist. Inevitably, therefore, the ascending length of the body with respect to the tamper evident bottom portion is limited. Thus, the container closure is applicable only when the ascent distance of the body when removed from the mouth-and-neck portion is relatively short (in other words, when the axial dimension of the external thread of the mouth-and-neck portion is relatively short).

Secondly, in rotating the body in the opening direction in order to unseal the mouth-and-neck portion, the body is excessively displaced in the circumferential direction with respect to the tamper evident bottom portion after breakage of the breakable bridge portions. As a result, great stress is caused to the unbroken connecting pieces, whereby the unbroken connecting pieces may be broken. There is also a possibility for the breakable bridge portions to be broken when the container closure is mounted on the mouth-and-neck portion.

Thirdly, when the contents of the container are all consumed, and the container and the container closure are discarded, it is desired that the entire container closure be removed from the mouth-and-neck portion of the container, from the viewpoint of so-called sorted collection and discarding of trash by the type of material. In the case of the container closure disclosed in the Patent Document 1, it is necessary to remove the tamper evident bottom portion from the mouth-and-neck portion of the container by a complicated procedure, for example, the procedure of breaking the tamper evident bottom portion in the axial direction with the use of a tool such as a cutting instrument, so that the entire container closure is removed from the mouth-and-neck portion of the container.

The present invention has been accomplished in the light of the above-mentioned facts. Its principal technical challenge is to improve the aforementioned container closure disclosed in the Patent Document 1 so as to be applicable, without posing problems, even when the ascent distance of the body when removed from the mouth-and-neck portion is relatively long.

Another technical challenge of the present invention is to present the following advantages, in addition to solving the above principal technical challenge: The displacement in the circumferential direction of the body with respect to the tamper evident bottom portion is fully suppressed. The breakage of the unbroken connecting pieces during unsealing of the mouth-and-neck portion is avoided sufficiently reliably. Moreover, the breakage of the breakable bridge portions during mounting of the container closure on the mouth-and-neck portion is avoided with sufficient reliability.

Still another technical challenge of the present invention is to enable the entire container closure to be removed from the mouth-and-neck portion of the container with sufficient ease when the container and the container closure are discarded, in addition to the solution of the aforementioned principal technical challenge.

Means for Solving the Problems

According to the present invention, the above-mentioned principal technical challenge is solved by forming each of the unbroken connecting pieces into a shape including two of the tilting portions whose tilting directions are opposite to each other.

That is, according to the present invention, there is provided as a synthetic resin container closure solving the above principal technical challenge, a synthetic resin container closure to be applied to a container in which an external thread and an engaging jaw portion located below the external thread are formed on an outer peripheral surface of a mouth-and-neck portion, the synthetic resin container closure including a body which has a top panel wall, and a cylindrical skirt wall extending downwardly from a peripheral edge of the top panel wall, and in which an internal thread to be screwed to the external thread is formed on an inner peripheral surface of the skirt wall, and a cylindrical tamper evident bottom portion which is connected to the skirt wall of the body via a plurality of breakable bridge portions arranged with spacing in a circumferential direction, and in which engaging means to be engaged with the engaging jaw portion is disposed on an inner peripheral surface of the tamper evident bottom portion, wherein a protruding piece protruding downward is disposed on the skirt wall of the body, and unbroken connecting pieces are disposed on both sides in the circumferential direction of the protruding piece, the unbroken connecting pieces connecting the skirt wall of the body and the tamper evident bottom portion, and each having a tilting portion whose inclination angle with respect to a vertical line is gradually decreased when the body is moved upward with respect to the tamper evident bottom portion, characterized in that each of the unbroken connecting pieces includes two of the tilting portions whose tilting directions are opposite to each other.

Preferably, one of the unbroken connecting pieces has a first tilting portion extending downwardly obliquely or substantially horizontally to one side in the circumferential direction, and a second tilting portion extending downwardly obliquely or substantially horizontally to the other side in the circumferential direction in succession to the first tilting portion, the first tilting portion and the second tilting portion being connected via an intermediate portion, and the other of the unbroken connecting pieces has a first tilting portion extending downwardly obliquely or substantially horizontally to the other side in the circumferential direction, and a second tilting portion extending downwardly obliquely or substantially horizontally to the one side in the circumferential direction in succession to the first tilting portion, the first tilting portion and the second tilting portion being connected via an intermediate portion. It is preferred that each of the unbroken connecting pieces has an upper end portion connecting the first tilting portion to a lower edge of the skirt wall, and a lower end portion connecting the second tilting portion to the tamper evident bottom portion, and the intermediate portion of each of the unbroken connecting portions has a thin-walled portion extending over an entire width in the circumferential direction. The aforementioned another technical challenge is solved by disposing guide pieces, which protrude upward between the protruding piece and the unbroken connecting pieces and are located close to both side edges of the protruding piece in the circumferential direction, in the tamper evident bottom portion. It is preferred that the body of the container closure be rotated in an opening direction to release the internal thread from the external thread of the mouth-and-neck portion, and then the body be pivoted, with the unbroken connecting pieces as hinge fulcrums, away from the mouth-and-neck portion, whereby an outside surface of a lower end part of the protruding piece is brought into contact with an upper surface of the engaging jaw portion. In the synthetic resin container closure for solving the aforementioned still another technical challenge, in a specific region in the circumferential direction, an upper edge of the tamper evident bottom portion is displaced below the upper edge thereof in other region, the protruding piece and the unbroken connecting pieces are disposed in the specific region, in the specific region at least one axially breakable line is disposed in the tamper evident bottom portion, and when the body is removed from the mouth-and-neck portion in order to unseal the mouth-and-neck portion, the breakable bridge portions are broken, but the axially breakable line is not broken, and the body is removed from the mouth-and-neck portion, with the tamper evident bottom portion remaining on the mouth-and-neck portion, and then the body removed from the mouth-and-neck portion is pulled to break the axially breakable line, whereby the tamper evident bottom portion is developed from an endless annular form into a strip-shaped form with ends, and the entire container closure is removed from the mouth-and-neck portion. Preferably, the axially breakable line is located on a side opposite to the protruding piece in the circumferential direction across a site of connection between the unbroken connecting piece and the tamper evident bottom portion.

EFFECTS OF THE INVENTION

In the synthetic resin container closure provided by the present invention, each of the unbroken connecting pieces is in a shape including two of the tilting portions whose tilting directions are opposite to each other. Thus, in comparison with a case where each unbroken connecting piece includes the single tilting portion alone, the permissible ascent distance of the body with respect to the tamper evident bottom portion is substantially doubled, without the need to increase the circumferential dimensions where the unbroken connecting pieces are present. Even if the ascent distance of the body when removed from the mouth-and-neck portion is relatively long, the container closure can be applied without posing problems.

Because of collaboration between the protruding piece and the guide pieces located close to both sides thereof, the displacement of the body in the circumferential direction with respect to the tamper evident bottom portion is sufficiently suppressed. As a result, the breakage of the unbroken connecting pieces during unsealing of the mouth-and-neck portion is avoided fully reliably, and the breakage of the breakable bridge portions during mounting of the container closure on the mouth-and-neck portion is avoided fully reliably.

There is no need to perform a complicated procedure, for example, the procedure of breaking the tamper evident bottom portion in the axial direction with the use of a tool such as a cutting instrument. Simply by pulling the body removed from the mouth-and-neck portion, the axially breakable line is broken. As a result, the tamper evident bottom portion is developed from an endless annular form into a strip-shaped form with ends. Thus, the entire container closure can be removed from the mouth-and-neck portion.

MODE FOR CARRYING OUT THE INVENTION

A preferred embodiment of a synthetic resin container closure constituted in accordance with the present invention will now be described in further detail with reference to the accompanying drawings.

Figure 1:
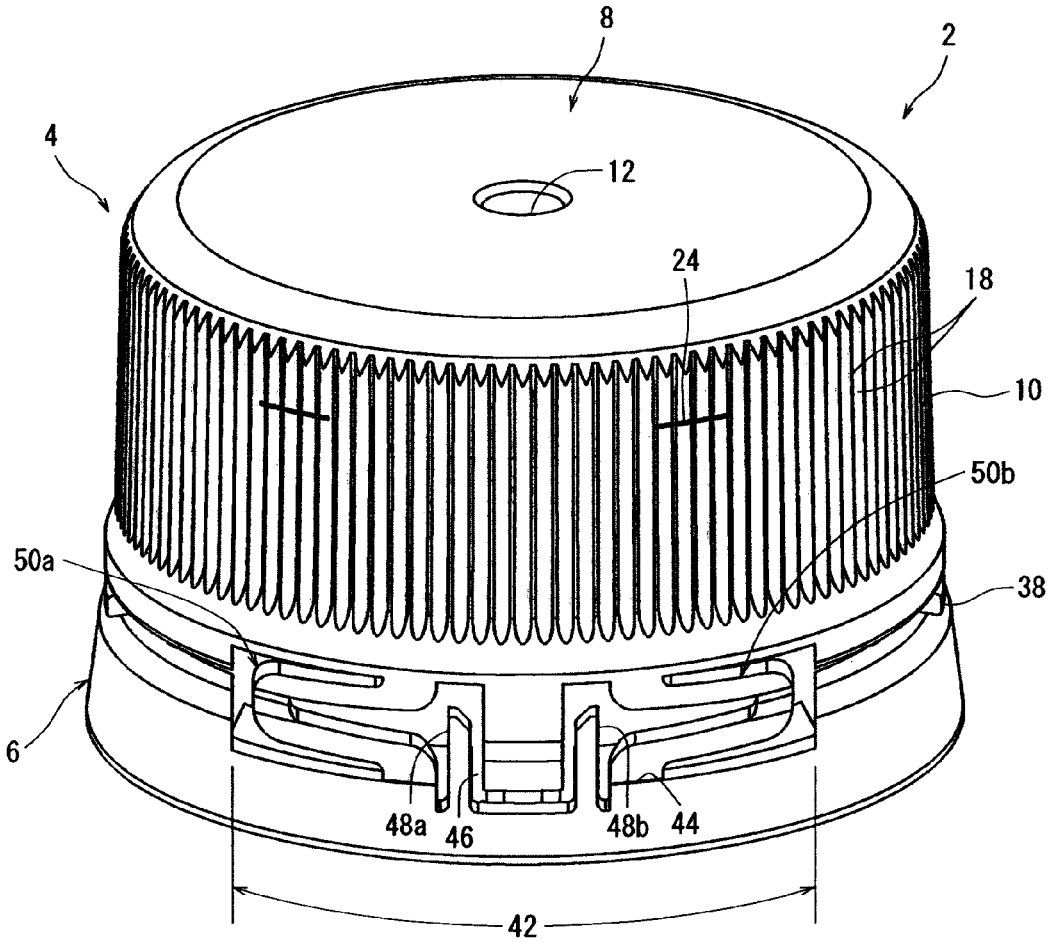
[FIG. 1] is a perspective view showing a preferred embodiment of a container closure constituted in accordance with the present invention.
Figure 2:
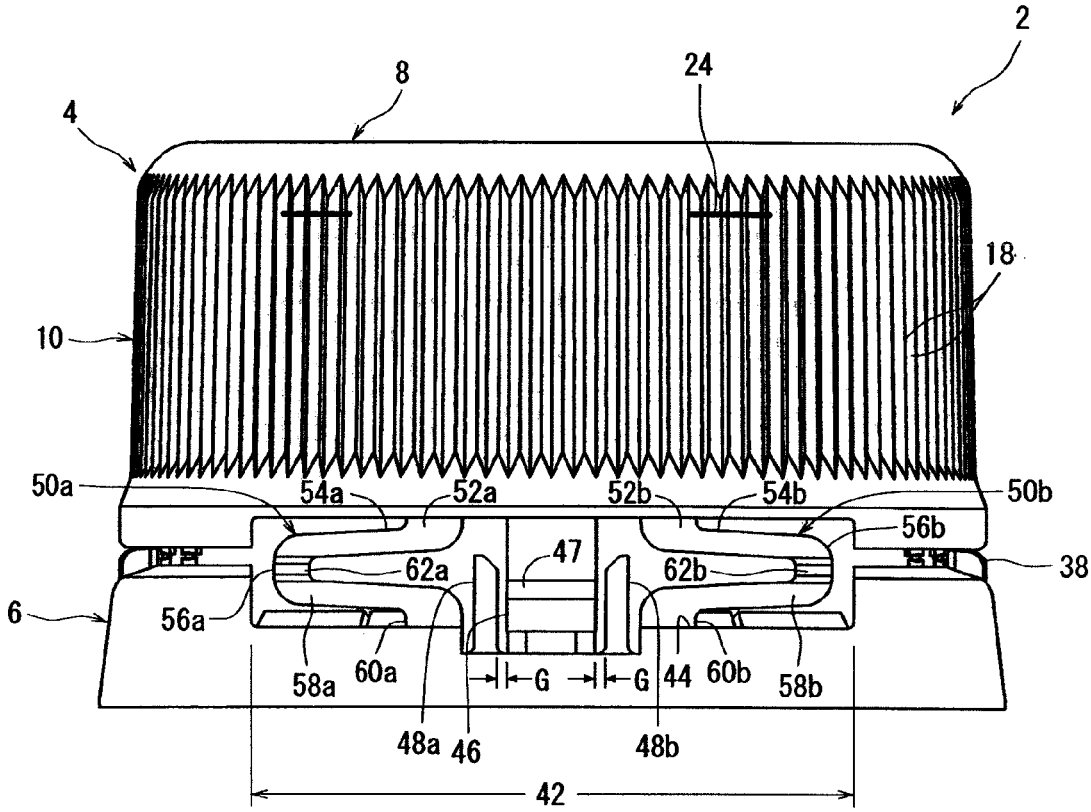
[FIG. 2] is a front view of the container closure in FIG. 1.
Figure 3:
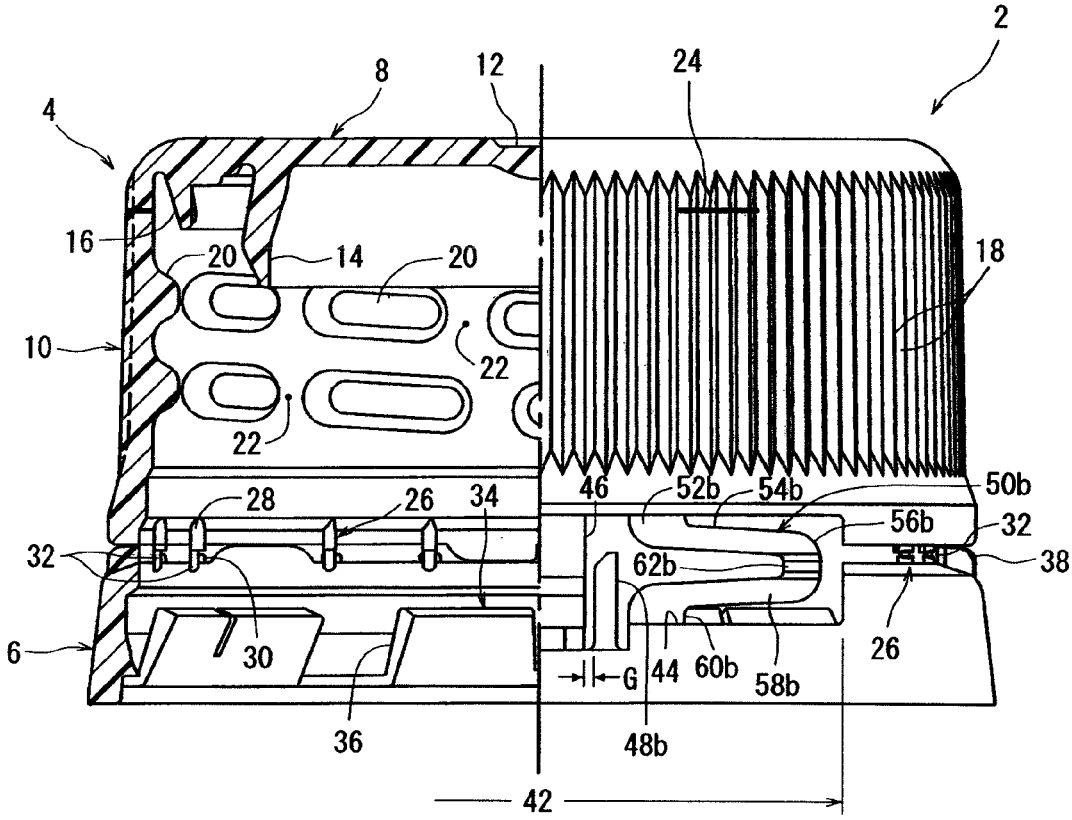
[FIG. 3] is a front view showing, partly in cross section, the container closure in FIG. 1.

With reference to FIGS. 1 to 3 showing the preferred embodiment of the synthetic resin container closure constituted in accordance with the present invention, the container closure designated entirely as the numeral 2 can be advantageously integral-molded from a suitable synthetic resin, such as polyethylene or polypropylene, by injection molding or compression molding. The container closure 2 includes a body 4 and a tamper evident bottom portion 6. The body 4 has a circular top panel wall 8, and a cylindrical skirt wall 10 extending downwardly from the peripheral edge of the top panel wall 8. A circular concavity 12 for avoiding the formation of a protrusion during injection molding is formed in the center of the upper surface of the top panel wall 8. Two sealing projections, i.e., an inner annular projection 14 and an outer annular projection 16, are formed on the inner surface of the top panel wall 8. On the outer peripheral surface of the skirt wall 10, irregularities 18 for preventing the slipperiness of fingers applied thereto are repeatedly formed. An internal thread 20 is formed on the inner peripheral surface of the skirt wall 10. In the internal thread 20, notches 22 are formed to be spaced in the circumferential direction. A plurality of slits 24 extending in the circumferential direction at circumferentially spaced locations are formed in an upper end portion of the skirt wall 10.

The tamper evident bottom portion 6 is cylindrical as a whole, and is connected to the skirt wall 10 of the body 4 via a plurality of breakable bridge portions 26 arranged with spacing in the circumferential direction. The breakable bridge portion 26 may be substantially the same as the breakable bridge portion disclosed in JP-A-2007-191206, and has an upper end part 28 connected to a lower end part of the inner peripheral surface of the skirt wall 10, a lower end part 30 connected to an upper end part of the inner peripheral surface of the tamper evident bottom portion 6, and an intermediate part 32 decreased in cross-sectional area. An engaging means 34 is disposed on the inner peripheral surface of the tamper evident bottom portion 6. The engaging means 34 in the illustrated embodiment is composed of a plurality of engaging pieces 36 arranged with spacing in the circumferential direction, and each of the engaging pieces 36 extends upward radially inwardly from the inner peripheral surface of the tamper evident bottom portion 6.

Figure 8:
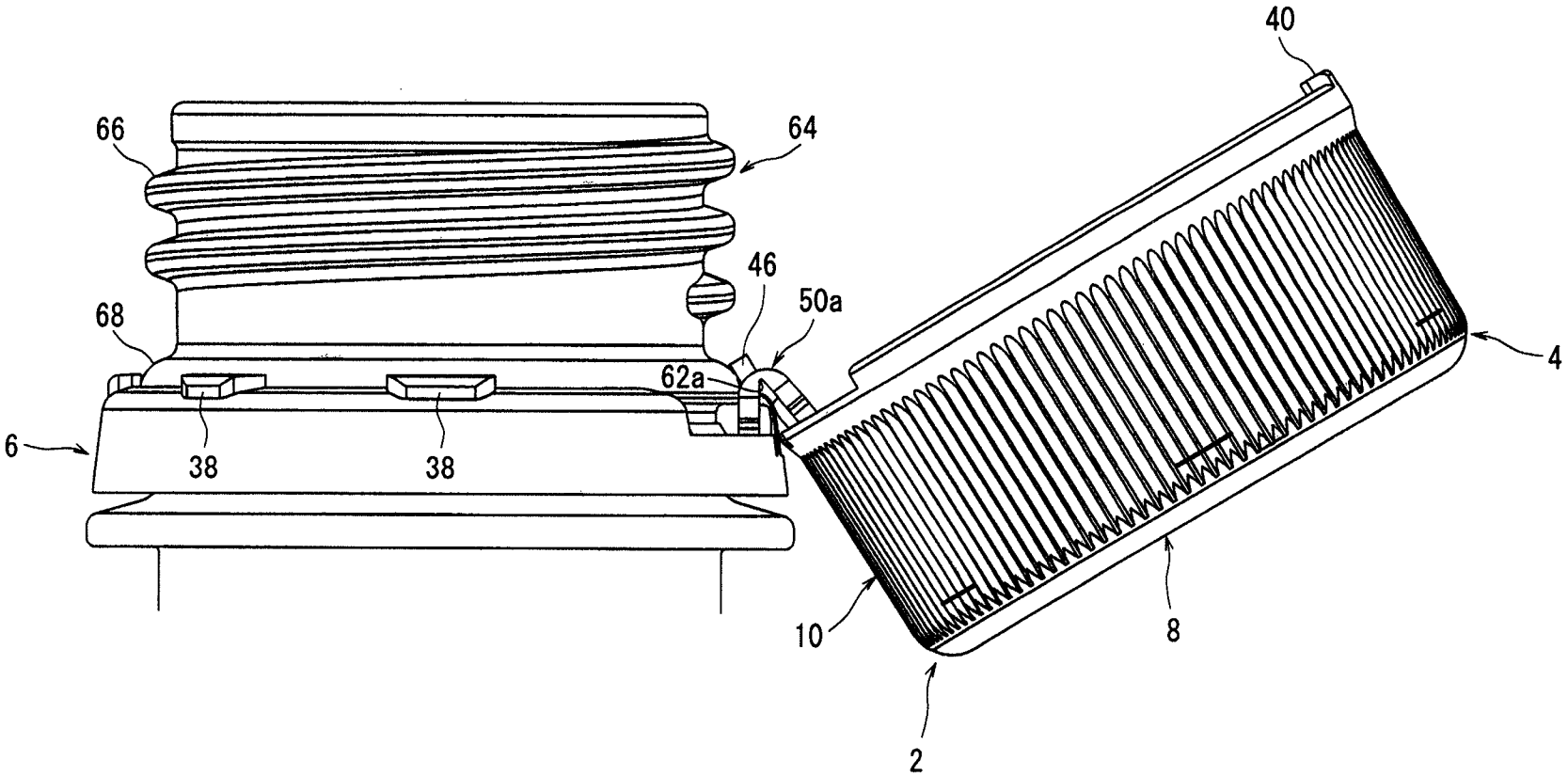
[FIG. 8] is a front view showing a state in which the body of the container closure in FIG. 1 has been removed from the mouth-and-neck portion of the container and held in place.

As will be clearly understood by reference to FIG. 8 along with FIGS. 1 to 3, a plurality of pedestal pieces 38 are formed on the upper end surface of the tamper evident bottom portion 6 at spaced locations in the circumferential direction. A pedestal piece 40 is also formed on the lower end surface of the body 4.

The above-described configuration in the illustrated container closure 2 does not constitute a novel feature of the container closure 2 constituted in accordance with the present invention. The container closure 2 may be in a well-known shape per se, and thus, a detailed description of this configuration will be omitted herein.

Figure 4:
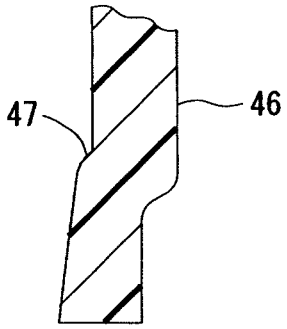
[FIG. 4] is a partial sectional view showing a protruding piece in the container closure in FIG. 1.

With further reference to FIGS. 1 to 3, in a region indicated by the numeral 42, the lower edge of the skirt wall 10 of the body 4 is displaced above its lower edge in other region, while the upper edge of the tamper evident bottom portion 6 is displaced below its upper edge in other region. In a central part of the region 42, moreover, the upper edge of the tamper evident bottom portion 6 is further displaced somewhat downward. As a result, an opening 44 of a nearly oblong rectangular shape in a front view is formed between the skirt wall 10 and the tamper evident bottom portion 6. In a central part in the circumferential direction of the opening 44, a nearly rectangular protruding piece 46 protruding downward is formed in the skirt wall 10. As will be clearly understood by reference to FIG. 4, the protruding piece 46 hangs down substantially vertically, is then slightly displaced radially outwardly, and then droops substantially vertically, with a stepped part 47 being formed on the outer surface thereof. In the tamper evident bottom portion 6, on the other hand, there are formed guide pieces 48*a* and 48*b* protruding upward on both sides of the protruding piece 46. It is important that the guide pieces 48*a* and 48*b* be close to both side edges of the protruding piece 46. It is preferred that the circumferential distance G between the protruding piece 46 and each of the guide pieces 48*a* and 48*b* be of the order of 0.3 to 1.0 mm.

As will be clearly illustrated in FIGS. 1 to 3, unbroken connecting pieces 50*a* and 50*b* located circumferentially outwardly of the guide pieces 48*a* and 48*b* are further disposed within the opening 44. In other words, the guide pieces 48*a* and 48*b* are disposed between the protruding piece 46 and the unbroken connecting pieces 50*a* and 50*b*, respectively. The unbroken connecting piece 50*a* in the illustrated embodiment is composed of an upper end portion 52*a* connected to the lower edge of the skirt wall 10, a first tilting portion 54*a* extending downwardly and obliquely in succession to the upper end portion 52*a* to one side in the circumferential direction (to the left side in FIGS. 1 and 2), an intermediate portion 56*a* extending nearly semicircularly, a second tilting portion 58*a* extending downwardly and obliquely in succession to the intermediate portion 56*a* to the other side in the circumferential direction (to the right side in FIGS. 1 and 2), and a lower end portion 60*a* connected to the tamper evident bottom portion 6. A thin-walled portion 62*a* extending over an entire width in the circumferential direction is present in the intermediate portion 56*a*. The unbroken connecting piece 50*b* is in line symmetry with the unbroken connecting piece 50*a*, and is composed of an upper end portion 52*b* connected to the lower edge of the skirt wall 10, a first tilting portion 54*b* extending downwardly and obliquely in succession to the upper end portion 52*b* to one side in the circumferential direction (to the left side in FIGS. 1 and 2), an intermediate portion 56*b* extending nearly semicircularly, a second tilting portion 58*b* extending downwardly and obliquely in succession to the intermediate portion 56*b* to the other side in the circumferential direction (to the right side in FIGS. 1 and 2), and a lower end portion 60*b* connected to the tamper evident bottom portion 6. A thin-walled portion 62*b* extending over an entire width in the circumferential direction is present in the intermediate portion 56*b*. If desired, the first tilting portion 54*a* and the second tilting portion 58*a* in the unbroken connecting piece 50*a*, and the first tilting portion 54*b* and the second tilting portion 58*b* in the unbroken connecting piece 50*b* can be allowed to extend substantially horizontally without being inclined in the predetermined directions.

Figure 5:
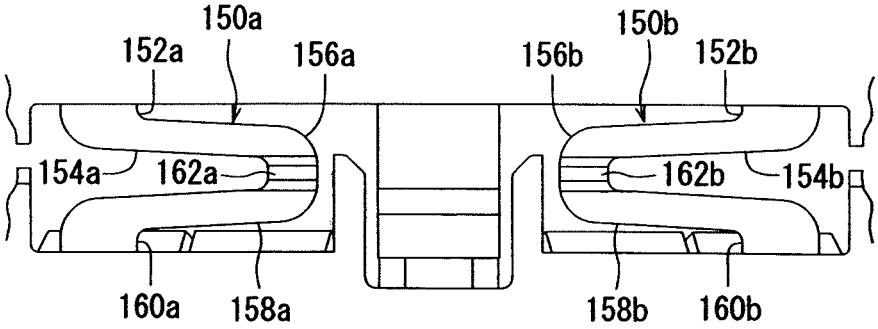
[FIG. 5] is a partial front view showing a modification of unbroken connecting pieces in the container closure in FIG. 1.

FIG. 5 illustrates an example of a modification of the unbroken connecting pieces. In the example of the modification illustrated in FIG. 5, an unbroken connecting piece 150*a* is composed of an upper end portion 152*a* connected to the lower edge of the skirt wall 10, a first tilting portion 154*a* extending downwardly and obliquely in succession to the upper end portion 152*a* to the other side in the circumferential direction (to the right side in FIGS. 1 and 2), an intermediate portion 156*a* extending nearly semicircularly, a second tilting portion 158*a* extending downwardly and obliquely in succession to the intermediate portion 156*a* to one side in the circumferential direction (to the left side in FIGS. 1 and 2), and a lower end portion 160*a* connected to the tamper evident bottom portion 6. A thin-walled portion 162*a* extending over an entire width in the circumferential direction is present in the intermediate portion 156*a*. An unbroken connecting piece 150*b* is in line symmetry with the unbroken connecting piece 150*a*, and is composed of an upper end portion 152*b* connected to the lower edge of the skirt wall 10, a first tilting portion 154*b* extending downwardly and obliquely in succession to the upper end portion 152*b* to the other side in the circumferential direction (to the right side in FIGS. 1 and 2), an intermediate portion 156*b* extending nearly semicircularly, a second tilting portion 158*b* extending downwardly and obliquely in succession to the intermediate portion 156*b* to one side in the circumferential direction (to the left side in FIGS. 1 and 2), and a lower end portion 160*b* connected to the tamper evident bottom portion 6. A thin-walled portion 162*b* extending over an entire width in the circumferential direction is present in the intermediate portion 156*b*.

Figure 6:
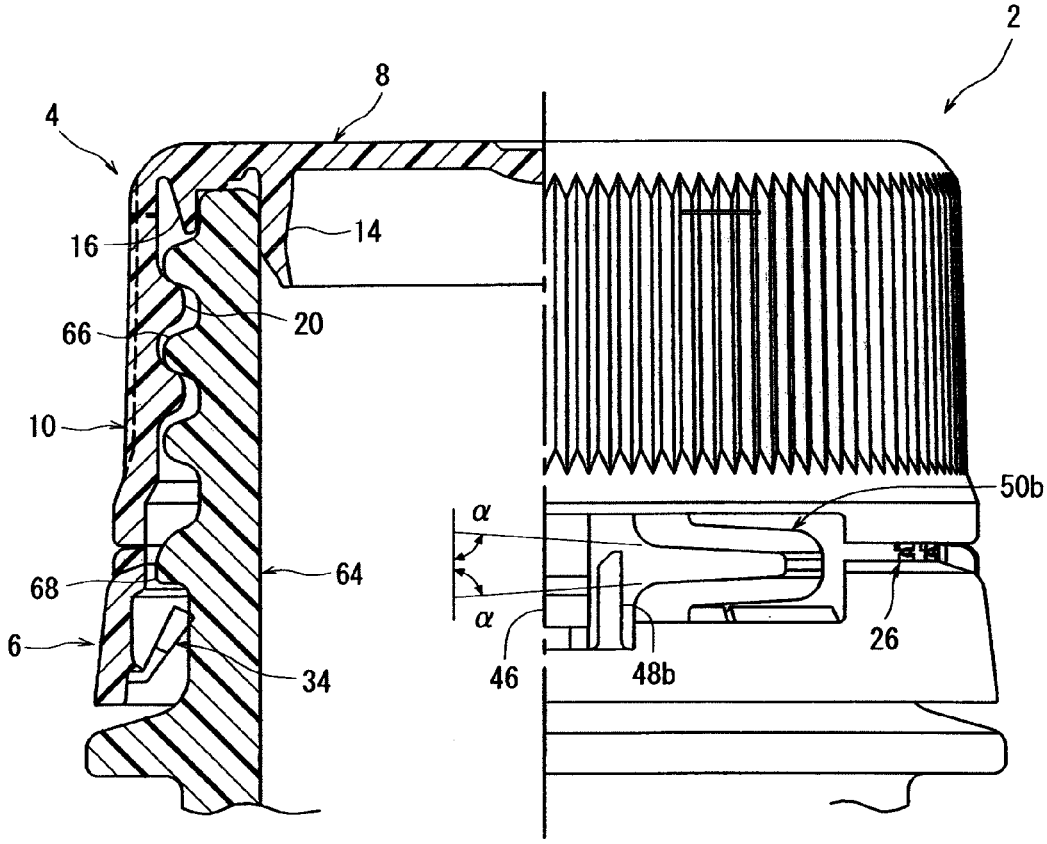
[FIG. 6] is a front view showing, partly in cross section, a state in which the container closure in FIG. 1 has been mounted on a mouth-and-neck portion of a container.

FIG. 6 shows a mouth-and-neck portion 64 of a container together with the container closure 2. The mouth-and-neck portion 64 of the container, which can be formed from a suitable synthetic resin such as polyethylene terephthalate or from glass, is in a cylindrical shape as a whole, and its upper surface is open. An external thread 66, and an engaging jaw portion 68 located below the external thread 66 are formed on the outer peripheral surface of the mouth-and-neck portion 64.

In mounting the container closure 2 on the mouth-and-neck portion 64 to seal the mouth-and-neck portion 64, the container closure 2 is fitted on the mouth-and-neck portion 64, and rotated in a closing direction (clockwise when viewed from above in FIG. 6) to screw the internal thread 20 of the container closure 2 to the external thread 66 of the mouth-and-neck portion 64. As the screwing of the internal thread 20 to the external thread 66 proceeds, the container closure 2 is lowered gradually down the mouth-and-neck portion 64. When the container closure 2 is lowered with respect to the mouth-and-neck portion 64 to a state as shown in FIG. 6, the inner annular projection 14 and the outer annular projection 16 formed on the inner surface of the top panel wall 8 in the body 4 of the container closure 2 are brought into intimate contact with the inner peripheral surface and the outer peripheral surface, respectively, of the mouth-and-neck portion 64, whereby the mouth-and-neck portion 64 is sealed. The engaging means 34 disposed on the inner peripheral surface of the tamper evident bottom portion 6 of the container closure 2 elastically passes over the engaging jaw portion 68 of the mouth-and-neck portion 64, and is brought into engagement with the lower surface of the engaging jaw portion 68.

In rotating the container closure 2 in the closing direction to mount it on the mouth-and-neck portion 64, particularly when the engaging means 34 passes over the engaging jaw portion 68, the tamper evident bottom portion 6 tries to move in the opening direction (counterclockwise when viewed from above in FIG. 6) relative to the body 4, because of resistance to rotation which acts on the tamper evident bottom portion 6. In the container closure 2 constituted in accordance with the present invention, however, when the tamper evident bottom portion 6 is slightly moved in the opening direction relative to the body 4, the guide piece 48*b* formed in the tamper evident bottom portion 6 contacts the protruding piece 46 formed in the skirt wall 10 of the body 4, thereby inhibiting the relative movement of the tamper evident bottom portion 6 in the opening direction with respect to the body 4. Thus, the breakage of the breakable bridge portions 26 upon application of excessive stress to the breakable bridge portions 26 is avoided sufficiently reliably.

Figure 7:
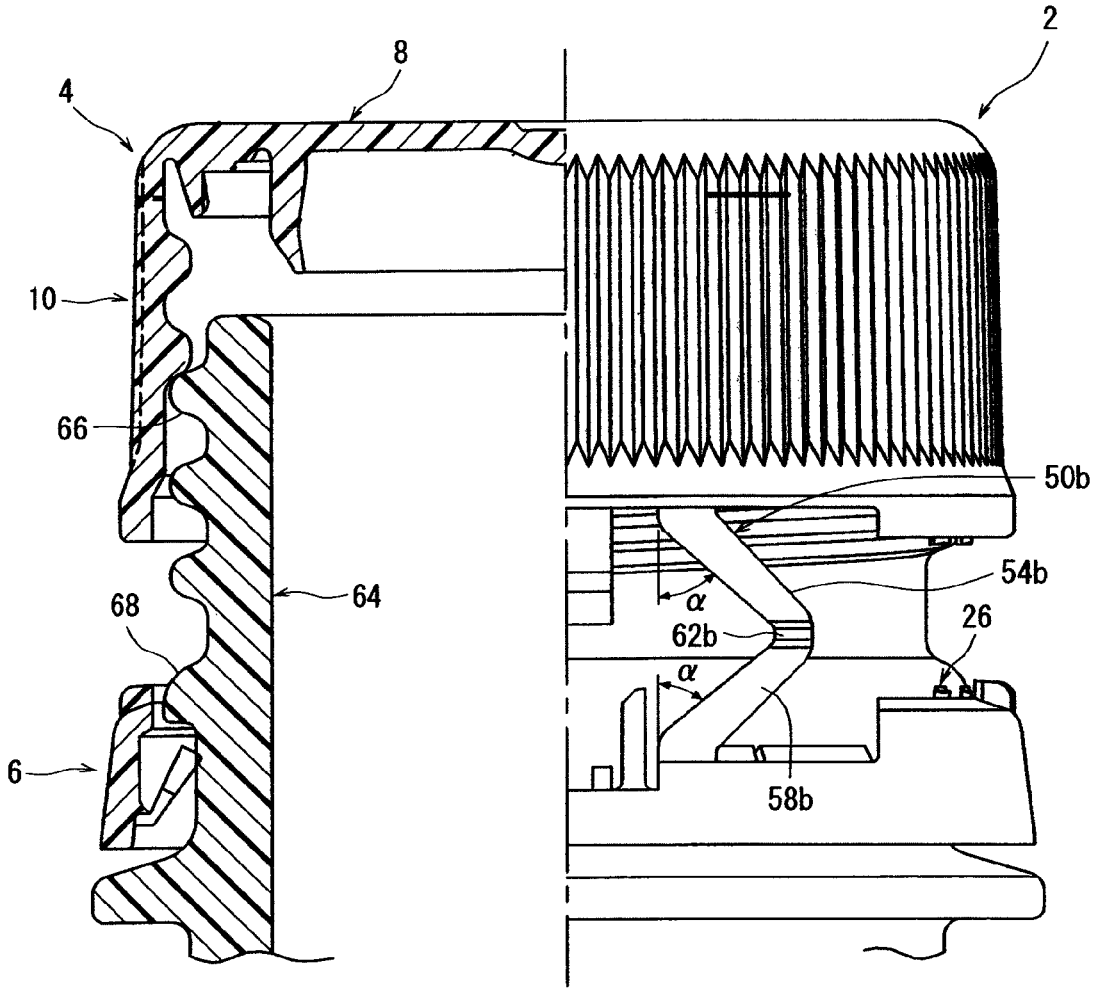
[FIG. 7] is a front view showing, partly in cross section, an intermediate state of an unsealing operation in which a body of the container closure in FIG. 1 has been rotated in an opening direction and raised thereby to be removed from the mouth-and-neck portion of the container.

In unsealing the mouth-and-neck portion 64, the container closure 2 is rotated in the opening direction (counterclockwise when viewed from above in FIG. 6) to gradually release the screwing of the internal thread 20 of the container closure 2 to the external thread 66 of the mouth-and-neck portion 64. Upon gradual release of the screwing, the body 4 of the container closure 2 is rotated in the opening direction and also allowed to ascend. On the other hand, the tamper evident bottom portion 6 is inhibited from ascending, because its engaging means 34 is in engagement with the engaging jaw portion 68 of the mouth-and-neck portion 64. Thus, considerable stress is caused to the breakable bridge portions 26, whereby the breakable bridge portions 26 are broken. Then, the body 4 of the container closure 2 ascends simultaneously with its rotation in the opening direction, and is gradually spaced upward from the tamper evident bottom portion 6. As will be clearly understood by reference to FIG. 7 along with FIG. 6, when the body 4 is gradually spaced upward from the tamper evident bottom portion 6, the first tilting piece 54*a* of the unbroken connecting piece 50*a* and the second tilting portion 58*b* of the unbroken connecting piece 50*b* are pivoted counterclockwise, that is, tilted counterclockwise in FIGS. 6 and 7, about their upper end and lower end, whereas the second tilting piece 58*a* of the unbroken connecting piece 50*a* and the first tilting portion 54*b* of the unbroken connecting piece 50*b* are pivoted clockwise, that is, tilted clockwise in FIGS. 6 and 7, about their lower end and upper end. In accordance with these motions, the first tilting portions 54*a* and 54*b* and the second tilting portions 58*a* and 58*b* of the unbroken connecting pieces 50*a* and 50*b* have their inclination angle α with respect to the vertical line gradually decreased. As will be clearly understood by reference to FIG. 8 along with FIGS. 6 and 7, when the screwing of the internal thread 20 of the container closure 2 to the external thread 66 of the mouth-and-neck portion 64 is completely released, the body 4 of the container closure 2 is removed from the mouth-and-neck portion 64. However, the body 4 continues to be connected via the unbroken connecting pieces 50*a* and 50*b* to the tamper evident bottom portion 6 continuously mounted on the mouth-and-neck portion 64, and thus is not separated from the mouth-and-neck portion 64 of the container.

In the container closure 2 constituted in accordance with the present invention, the unbroken connecting pieces 50*a* and 50*b* each include the two tilting portions whose tilting directions are opposite to each other, namely, the first tilting portion 54*a* and the second tilting portion 58*a*, and the first tilting portion 54*b* and the second tilting portion 58*b*. Thus, although the circumferential dimensions where the unbroken connecting pieces 50*a* and 50*b* exist are relatively small, the body 4 is permitted to be spaced upward over a considerable length with respect to the tamper evident bottom portion 6. Hence, even if the body 4 needs to be raised over a considerable length so as to be removed from the mouth-and-neck portion 64, the body 4 can be removed from the mouth-and-neck portion 64 without occurrence of a particular problem. Furthermore, in the container closure 2 constituted in accordance with the present invention, the following facts should also be noted: Owing to resistance to rotation in the opening direction which acts on the tamper evident bottom portion 6, the tamper evident bottom portion 6 tries to move in the closing direction (clockwise in FIGS. 6 and 7) relative to the body 4. However, when the tamper evident bottom portion 6 is slightly moved in the closing direction relative to the body 2, the guide piece 48*a* formed in the tamper evident bottom portion 6 contacts the protruding piece 46 formed in the skirt wall 10 of the body 4, thereby inhibiting the relative movement of the tamper evident bottom portion 6 in the closing direction with respect to the body 4. Thus, the breakage of the unbroken connecting pieces 50*a* and 50*b* under excessive stress on the unbroken connecting pieces 50*a* and 50*b* is avoided sufficiently reliably.

After the body 4 of the container closure 2 is removed from the mouth-and-neck portion 64, the body 4 is pivoted, with the thin-walled portions 62*a* and 62*b* of the unbroken connecting pieces 50*a* and 50*b* as hinge fulcrums, away from the mouth-and-neck portion 64 until the state illustrated in FIG. 8 is achieved. By so doing, the protruding piece 46 formed in the body 4 is elastically deformed to some extent, and passed over the engaging jaw portion 68 of the mouth-and-neck portion 64. As a result, the outer surface of a lower end part (front end part) of the protruding piece 46 contacts the upper surface of the engaging jaw portion 68 of the mouth-and-neck portion 64, and the stepped part 47 formed on the outer surface of the protruding piece 46 is brought into engagement with the upper surface of the engaging jaw portion 68. Also, the lower end of the skirt wall 10 of the body 4 contacts the outer peripheral surface of the tamper evident bottom portion 6. Thus, the body 4 is releasably held at the position shown in FIG. 8. Consequently, a consumer can eat and drink contents, such as a soft drink, present in the container, without being impeded by the presence of the body 4. When the protruding piece 46 passes over the engaging jaw portion 68 of the mouth-and-neck portion 64, moreover, a sound is produced by the elastic deformation and elastic restoration of the protruding piece 46, making it possible to confirm aurally that the protruding piece 46 has passed over the engaging jaw portion 68.

When eating and drinking of the contents are interrupted, the body 4 held at the position shown in FIG. 8 is pivoted toward the mouth-and-neck portion 64 and fitted thereon again. Then, the container closure 2 is rotated in the closing direction to screw the internal thread 20 of the container closure 2 to the external thread 66 of the mouth-and-neck portion 64. In this manner, the container closure 2 is positioned again in the state shown in FIG. 6, whereby the mouth-and-neck portion 64 can be temporarily sealed.

Figure 9:
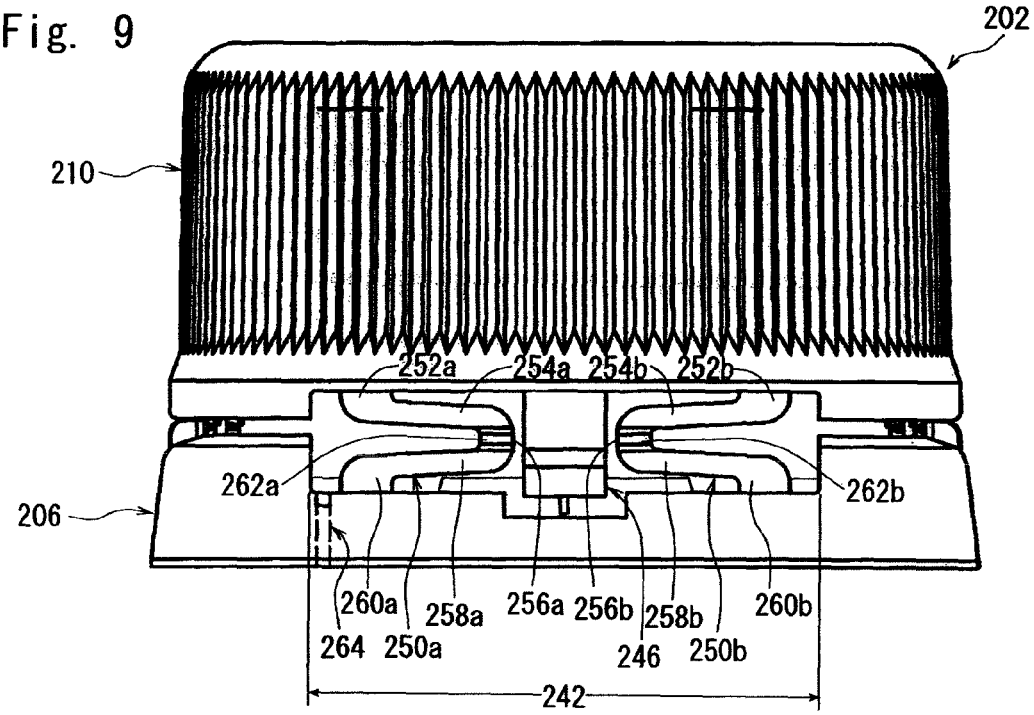
[FIG. 9] is a front view showing another embodiment of the container closure constituted in accordance with the present invention.

FIG. 9 shows another embodiment of the synthetic resin container closure constituted in accordance with the present invention. A container closure 202 shown in FIG. 9 is different from the container closure 2 shown in FIGS. 1 to 4 in that (1) the guide pieces 48*a* and 48*b* are not disposed, (2) unbroken connecting pieces 250*a* and 250*b* are substantially the same as those in the modification shown in FIG. 5, and (3) an axially breakable line 264 is formed in a tamper evident bottom portion 206.

In the embodiment illustrated in FIG. 9, the unbroken connecting piece 250*a* provided in a region 242 is composed of an upper end portion 252*a* connected to the lower edge of a skirt wall 210, a first tilting portion 254*a* extending downwardly and obliquely in succession to the upper end portion 252*a* to the other side in the circumferential direction (to the right side in FIG. 9), an intermediate portion 256*a* extending nearly semicircularly, a second tilting portion 258*a* extending downwardly and obliquely in succession to the intermediate portion 256*a* to one side in the circumferential direction (to the left side in FIGS. 1 and 2), and a lower end portion 260*a* connected to the tamper evident bottom portion 206. A thin-walled portion 262*a* extending over an entire width in the circumferential direction is present in the intermediate portion 256*a*. The unbroken connecting piece 250*b* is in line symmetry with the unbroken connecting piece 250*a*, and is composed of an upper end portion 252*b* connected to the lower edge of the skirt wall 210, a first tilting portion 254*b* extending downwardly and obliquely in succession to the upper end portion 252*b* to the one side in the circumferential direction (to the left side in FIG. 9), an intermediate portion 256*b* extending nearly semicircularly, a second tilting portion 258*b* extending downwardly and obliquely in succession to the intermediate portion 256*b* to the other side in the circumferential direction (to the right side in FIG. 4), and a lower end portion 260*b* connected to the tamper evident bottom portion 206. A thin-walled portion 262*b* extending over an entire width in the circumferential direction is present in the intermediate portion 256*b*.

In the embodiment shown in FIG. 9, the single axially breakable line 264 is formed on the left side of the site of connection between the unbroken connecting portion 250*a* and the tamper evident bottom portion 206, namely, the lower end portion 260*a* of the unbroken connecting piece 250*a*, in other words, on the side opposite to a protruding piece 246 across the site of connection between the unbroken connecting portion 250*a* and the tamper evident bottom portion 206.

If desired, there can be disposed, in addition to or in place of the axially breakable line 264, an axially breakable line on the right side of the site of connection between the unbroken connecting portion 250*b* and the tamper evident bottom portion 206, namely, the lower end portion 260*b* of the unbroken connecting piece 250*b*, in other words, on the side opposite to the protruding piece 246 across the site of connection between the unbroken connecting portion 250*b* and the tamper evident bottom portion 206.

Figure 10:
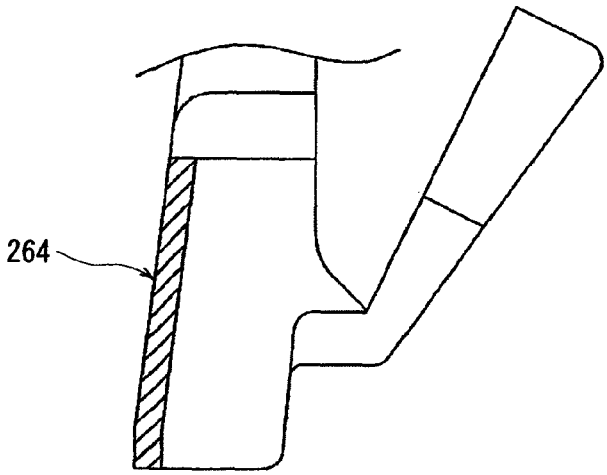
[FIG. 10] is a partial sectional view showing an axially breakable line of the container closure in FIG. 9.
Figure 11:
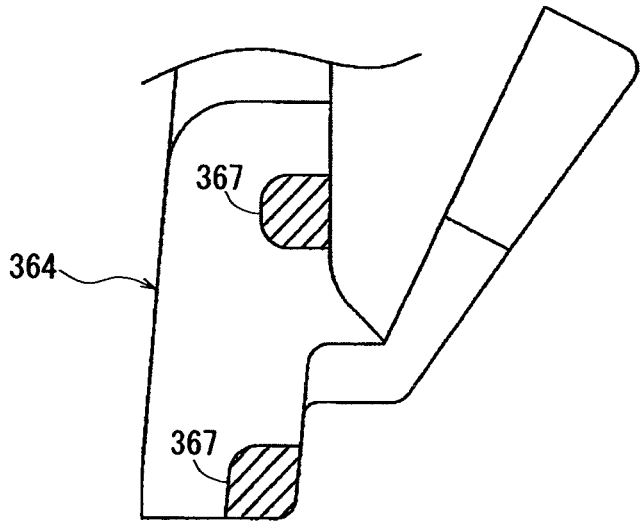
[FIG. 11] is a partial sectional view showing a modification of the axially breakable line.
Figure 12:
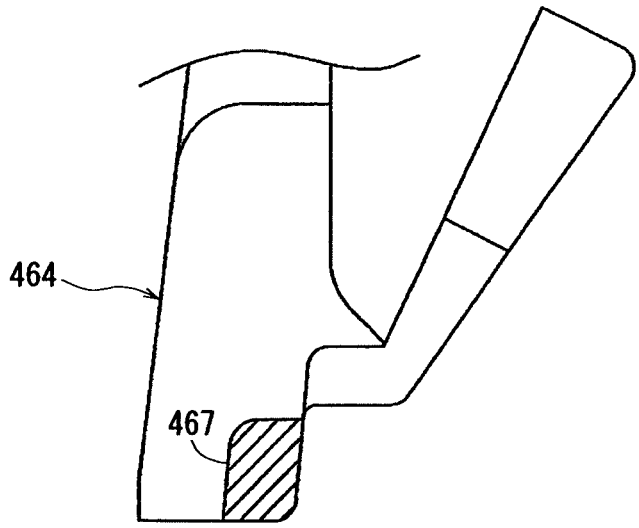
[FIG. 12] is a partial sectional view showing another modification of the axially breakable line.

As will be clearly understood by reference to FIG. 10, the axially breakable line 264 is composed of a slit (kerf) present in an upper end part, and a thin-walled score following it. FIGS. 11 and 12 show modifications of the axially breakable line. An axially breakable line 364 shown in FIG. 11 is composed of two bridge portions 367 disposed with spacing in the axial direction. In the axially breakable line 364, the tamper evident bottom portion 206 is continued via the two bridge portions 367 alone. An axially breakable line 464 shown in FIG. 12 is composed of one bridge portion 467 and, in the axially breakable line 464, the tamper evident bottom portion 206 is continued via the one bridge portion 467 alone. The breaking strength of the axially breakable lines 264, 364 and 464 is importantly such that the axially breakable lines 264, 364 and 464 are not broken when the body 204 of the container closure 202 is removed from the mouth-and-neck portion in order to unseal the mouth-and-neck portion of the container, but they are broken sufficiently easily by pulling the body 204 removed from the mouth-and-neck portion.

In the container closure shown in FIG. 9, when the container and the container closure 2 are discarded after the contents of the container are consumed, the body 204 is gripped and pulled in a suitable direction, for example, downward, with the body 204 being removed from the mouth-and-neck portion (see FIG. 8). By so doing, stress is imposed on the axially breakable line 264 of the tamper evident bottom portion 6 via the unbroken connecting portions 250*a* and 250*b*, whereby the axially breakable line 264 is broken. As a result, the tamper evident bottom portion 206 is developed from an endless annular form into a strip-shaped form with ends. Thus, the body 204 is further pulled away from the mouth-and-neck portion, whereby the tamper evident bottom portion 206 can be removed from the mouth-and-neck portion, and the entire container closure 202 can be removed from the mouth-and-neck portion.

The invention claimed is:

1. A synthetic resin container closure to be applied to a container in which an external thread and an engaging jaw portion located below the external thread are formed on an outer peripheral surface of a mouth-and-neck portion, the synthetic resin container closure including a body which has a top panel wall, and a cylindrical skirt wall extending downwardly from a peripheral edge of the top panel wall, and in which an internal thread to be screwed to the external thread is formed on an inner peripheral surface of the skirt wall, and a cylindrical tamper evident bottom portion which is connected to the skirt wall of the body via a plurality of breakable bridge portions arranged with spacing in a circumferential direction, and in which engaging means to be engaged with the engaging jaw portion is disposed on an inner peripheral surface of the tamper evident bottom portion, wherein a protruding piece protruding downward is disposed on the skirt wall of the body, and unbroken connecting pieces are disposed on both sides in the circumferential direction of the protruding piece, the unbroken connecting pieces connecting the skirt wall of the body and the tamper evident bottom portion, and each having a tilting portion whose inclination angle with respect to a vertical line is gradually decreased when the body is moved upward with respect to the tamper evident bottom portion, characterized in that each of the unbroken connecting pieces includes two of the tilting portions whose tilting directions are opposite to each other.

2. The synthetic resin container closure according to claim 1, wherein one of the unbroken connecting pieces has a first tilting portion extending downwardly obliquely or substantially horizontally to one side in the circumferential direction, and a second tilting portion extending downwardly obliquely or substantially horizontally to the other side in the circumferential direction in succession to the first tilting portion, the first tilting portion and the second tilting portion being connected via an intermediate portion, and the other of the unbroken connecting pieces has a first tilting portion extending downwardly obliquely or substantially horizontally to the other side in the circumferential direction, and a second tilting portion extending downwardly obliquely or substantially horizontally to the one side in the circumferential direction in succession to the first tilting portion, the first tilting portion and the second tilting portion being connected via an intermediate portion.

3. The synthetic resin container closure according to claim 2, wherein each of the unbroken connecting pieces has an upper end portion connecting the first tilting portion to a lower edge of the skirt wall, and a lower end portion connecting the second tilting portion to the tamper evident bottom portion, and the intermediate portion of each of the unbroken connecting portions has a thin-walled portion extending over an entire width in the circumferential direction.

4. The synthetic resin container closure according to claim 1, wherein guide pieces, which protrude upward between the protruding piece and the unbroken connecting pieces and are located close to both side edges of the protruding piece in the circumferential direction, are disposed in the tamper evident bottom portion.

5. The synthetic resin container closure according to claim 1, wherein the body of the container closure is rotated in an opening direction to release the internal thread from the external thread of the mouth-and-neck portion, and then the body is pivoted, with the unbroken connecting pieces as hinge fulcrums, away from the mouth-and-neck portion, whereby an outside surface of a lower end part of the protruding piece is brought into contact with an upper surface of the engaging jaw portion.

6. The synthetic resin container closure according to claim 1, wherein in a specific region in the circumferential direction, an upper edge of the tamper evident bottom portion is displaced below the upper edge thereof in other region, the protruding piece and the unbroken connecting pieces are disposed in the specific region, in the specific region at least one axially breakable line is disposed in the tamper evident bottom portion, and when the body is removed from the mouth-and-neck portion in order to unseal the mouth-and-neck portion, the breakable bridge portions are broken, but the axially breakable line is not broken, and the body is removed from the mouth-and-neck portion, with the tamper evident bottom portion remaining on the mouth-and-neck portion, and then the body removed from the mouth-and-neck portion is pulled to break the axially breakable line, whereby the tamper evident bottom portion is developed from an endless annular form into a strip-shaped form with ends, and the entire container closure is removed from the mouth-and-neck portion.

7. The synthetic resin container closure according to claim 6, wherein the axially breakable line is located on a side opposite to the protruding piece in the circumferential direction across a site of connection between the unbroken connecting piece and the tamper evident bottom portion.

* * * * *